US010194688B2

(12) United States Patent
Roberto, Jr. et al.

(10) Patent No.: US 10,194,688 B2
(45) Date of Patent: Feb. 5, 2019

(54) MEDICAMENT MANAGEMENT KIT

(71) Applicants: George Roberto, Jr., Wakefield, MA (US); G. Timothy Ryan Roberto, Wakefield, MA (US)

(72) Inventors: George Roberto, Jr., Wakefield, MA (US); G. Timothy Ryan Roberto, Wakefield, MA (US)

(73) Assignee: George Roberto, Jr., Wakefield, MA (US)

( * ) Notice: Subject to any disclaimer, the term of this patent is extended or adjusted under 35 U.S.C. 154(b) by 247 days.

(21) Appl. No.: 15/159,449

(22) Filed: May 19, 2016

(65) Prior Publication Data

US 2017/0332697 A1 Nov. 23, 2017

(51) Int. Cl.

| | |
|---|---|
| ***A24F 9/16*** | (2006.01) |
| ***A24B 7/06*** | (2006.01) |
| ***A24F 9/04*** | (2006.01) |
| ***A61J 7/00*** | (2006.01) |

(52) U.S. Cl.

CPC ..... *A24F 9/16* (2013.01); *A24B 7/06* (2013.01); *A24F 9/04* (2013.01); *A61J 7/0076* (2013.01); *A61J 7/0007* (2013.01)

(58) Field of Classification Search

CPC ..... A24F 9/16; A24F 9/04; A24F 7/06; A24F 15/08; A24F 15/18; A61J 1/00; A47J 42/38; B65D 43/166; B65D 85/70; Y10T 16/53607; A24B 7/06; A24B 7/00; B02C 18/06

USPC ..... 206/236, 261, 263; 131/311; 16/254; 241/273.3, 273.1, 168

See application file for complete search history.

(56) References Cited

U.S. PATENT DOCUMENTS

| | | | | | |
|---|---|---|---|---|---|
| 1,672,766 | A * | 6/1928 | March | A45C 11/24 | 206/236 |
| 2,556,478 | A * | 6/1951 | Marbell | A24F 15/18 | 206/246 |
| 5,848,596 | A * | 12/1998 | Zelenik | A24F 23/04 | 131/329 |
| 5,996,783 | A * | 12/1999 | Herchelroth | A24F 19/0064 | 206/245 |
| 6,041,921 | A * | 3/2000 | Staiano | A24F 23/04 | 206/236 |
| D627,508 | S * | 11/2010 | Showers | D27/185 | |
| 8,393,563 | B2 * | 3/2013 | Chaoui | B02C 18/08 | 241/168 |
| 8,863,947 | B2 * | 10/2014 | Sibley | B65B 61/20 | 206/213.1 |
| 9,730,554 | B2 * | 8/2017 | Chan | A47J 42/34 | |
| 2004/0144660 | A1 * | 7/2004 | Staiano | A24F 23/04 | 206/236 |
| 2005/0205460 | A1 * | 9/2005 | Atkin | A61C 7/12 | 206/564 |

(Continued)

OTHER PUBLICATIONS

Herb Grinders—Compare Top Rated Bud Grinders. (n.d.). Retrieved May 19, 2016, from http://weedgrinders420.com/.

(Continued)

*Primary Examiner* — Steven A. Reynolds
(74) *Attorney, Agent, or Firm* — Tor-Kit

(57) ABSTRACT

A medicament management kit for managing medical marijuana, wherein all the paraphernalia necessary for managing the storage and dispensing of medical marijuana are in a convenient and durable compact kit.

6 Claims, 4 Drawing Sheets

(56) References Cited

U.S. PATENT DOCUMENTS

| | | | | |
|---|---|---|---|---|
| 2005/0224088 | A1* | 10/2005 | Willis | A24F 3/00 131/329 |
| 2008/0314778 | A1* | 12/2008 | Hatton | A24F 9/00 206/256 |
| 2011/0094059 | A1* | 4/2011 | Sze | B29C 49/48 16/386 |
| 2011/0180433 | A1* | 7/2011 | Rennecamp | A24F 9/16 206/268 |
| 2013/0025608 | A1* | 1/2013 | Fakhouri | A24F 9/00 131/311 |
| 2014/0261471 | A1* | 9/2014 | Ruzycky | A24C 5/02 131/108 |
| 2014/0262884 | A1* | 9/2014 | Priebe | A61J 1/03 206/365 |
| 2015/0366264 | A1* | 12/2015 | Theron | A24F 15/08 206/85 |
| 2017/0319009 | A1* | 11/2017 | Seckel | A47J 42/34 |

OTHER PUBLICATIONS

Dinner & Menu Ideas. (n.d.). Retrieved May 19, 2016, from http://www.mccormick.com/.

Homeopathic Manufacturer, Herbal Product Manufacturer, Supplement Manufacturer—Apotheca Inc. (n.d.). Retrieved May 19, 2016, from http://apothecacompany.com/.

Custom Herb Grinders | Laser Engraved Personalized Grinders. (n.d.). Retrieved May 19, 2016, from http://customherbgrinders.com/.

* cited by examiner

MEDICAMENT MANAGEMENT KIT

BACKGROUND OF THE INVENTION

The present invention relates to medicament management kits and, more particularly, to a medicament management kit for managing medical marijuana.

As of this writing, about half of the state of the United States of America have legalized or at least de-criminalized medicinal marijuana. As such, there is a need for a compact kit to manage said medicament for storage and delivery purposes. Current medical marijuana paraphernalia are sold separately and do not have an all in one kit, and so users tend to either misplace the paraphernalia or fabricate makeshift storage devices which are not economically organized.

Furthermore, it would be beneficial to have a medicament management kit specifically for out-of-home activities. Such portable medicament management kits need to be small if they are going to be carried by everyday people doing said out-of-home activities. Often, the medicament management kit may be in the form of a container, which must be opened to find and pick out the contents. And so it would be a boon in today's fast-paced society, for users to be able to quickly and easily access the contents of the medicament management kit without having to be fumbling through the container only to find that the desired item is damaged because of the tight or loosely kept storage conditions.

As can be seen, there is a need for a medicament management kit for managing medical marijuana, wherein all the paraphernalia necessary for managing the storage and dispensing of medical marijuana are in a convenient and durable compact kit.

SUMMARY OF THE INVENTION

In one aspect of the present invention, a medicament management kit includes a main body; a lid; a plurality of hinge knuckles spaced apart along cooperating edges of both the main body and the lid so that the plurality of hinge knuckles align to define a singular lumen; a hinge pin in the singular lumen so that the lid is pivotally coupled to the main body so as to moveable between a closed condition defining an interior housing and an open condition to access said interior housing; and a plurality of medicament paraphernalia disposed within said interior housing, wherein the plurality of medicament paraphernalia comprises a tubular pipe, wherein the hinge pin is dimensioned and adapted to slide out of the singular lumen and into the tubular pipe for cleaning said tubular pipe.

In another aspect of the present invention, the medicament management kit includes a main body; a lid pivotally coupled to the main body so as to moveable between a closed condition defining an interior housing and an open condition to access said interior housing; wherein the interior housing provides a stationary grinder portion connected to the main body and a rotating grinder portion connected to the lid, and wherein the stationary and rotating grinder portions abut in the closed condition; and an operative surface of the rotating grinder portion protruding through the lid, wherein the operative surface provides a grinder arm operatively connected to the rotating grinder portion for selectively rotating grinder portion rotates relative to the stationary grinder portion.

In yet another aspect of the present invention, the medicament management kit further includes a plurality of grinder spikes in both the stationary and rotating grinder portion; a medicament tray having a plurality of holes for slidably receiving the plurality of grinder spikes of the stationary grinder portion for nesting the medicament tray in the stationary grinder portion; a plurality of paraphernalia retained in the interior housing, wherein the plurality of medicament paraphernalia comprises a tubular pipe; and a plurality of hinge knuckles spaced apart along cooperating edges of both the main body and the lid so that the plurality of hinge knuckles align to define a singular lumen; and a hinge pin in the singular lumen so that the lid is pivotally coupled to the main body, wherein the hinge pin is dimensioned and adapted to slide out of the singular lumen and into the tubular pipe for cleaning said tubular pipe, and wherein the plurality of medicament paraphernalia comprises a lighter.

These and other features, aspects and advantages of the present invention will become better understood with reference to the following drawings, description and claims.

DETAILED DESCRIPTION OF THE INVENTION

Figure 1:
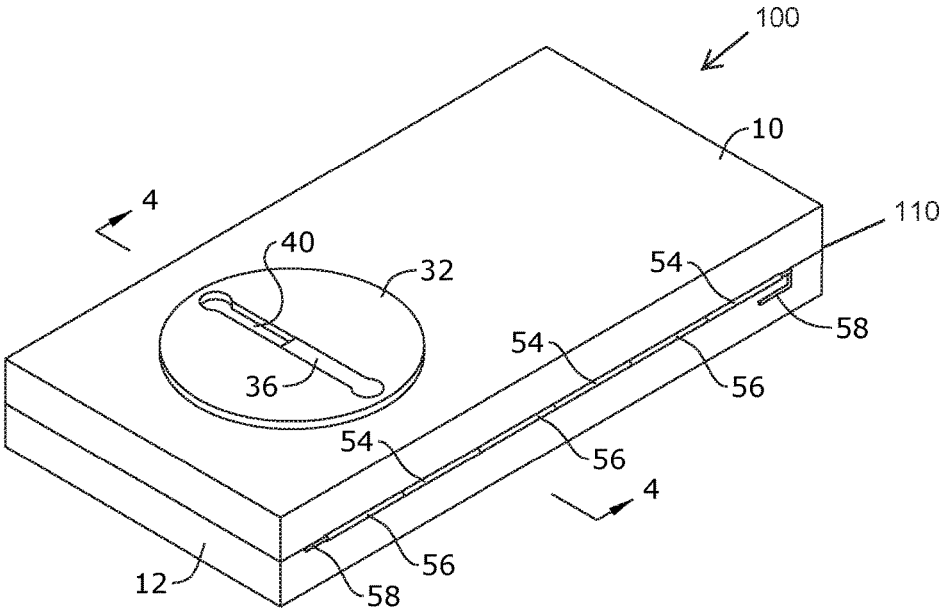
FIG. 1 is a perspective view of an exemplary embodiment of the present invention, shown in a closed condition.
Figure 2:
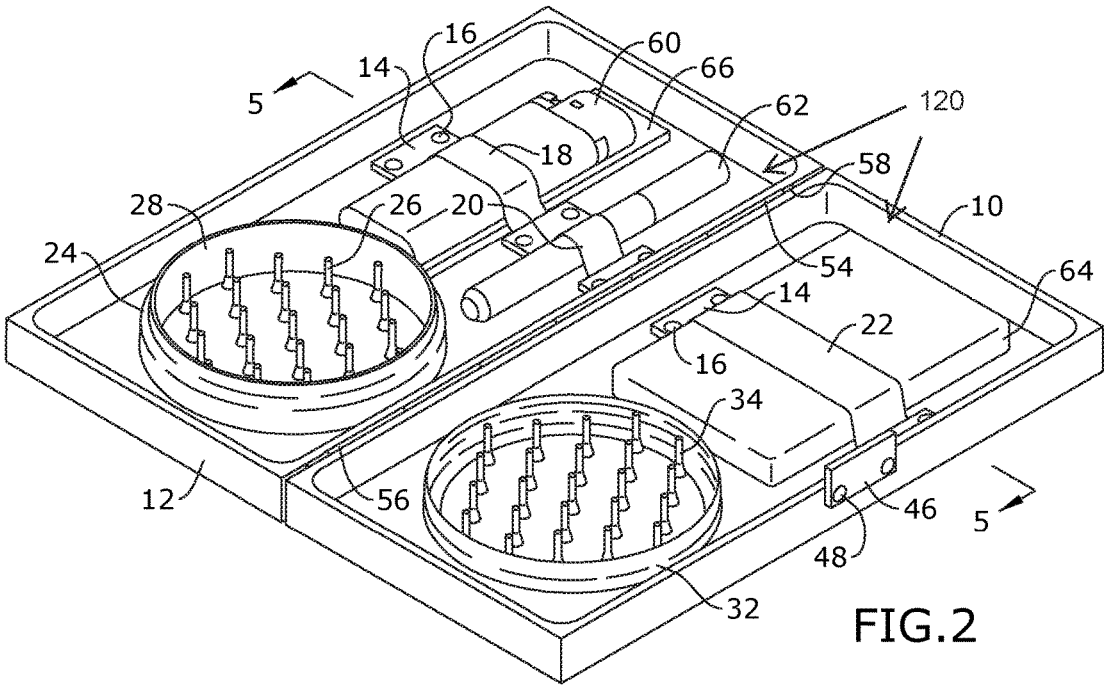
FIG. 2 is an exploded view of an exemplary embodiment of the present invention, shown in an open condition.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a medicament management kit for managing medical marijuana, wherein all the paraphernalia necessary for managing the storage and dispensing of medical marijuana are in a convenient and durable compact kit.

Referring to FIGS. 1 through 7, the present invention may include an exemplary portable medicament management kit 100 has a housing 110 in the form of a relatively rigid case having a main body 12 and a lid 10. The main body 12 and the lid 10 are configured to have an interior 120 configured to receive, hold, and maintain the medicament 68 and desired paraphernalia for the dispensing of the medicament 68, namely, a lighter 60, a pack of rolling papers 66, a pipe 62, and a storage container 64 for holding the medicament (illustrated as a plurality of medicament clumps 68, but which may be in the form of a bud). It will be appreciated that the interior 120 preferably is sized and shaped to substantially yet economically retain typical medicinal marijuana paraphernalia.

Retaining elements, such as retaining straps 18, 20, 22, are provided to maintain one or more desired paraphernalia in place within the interior 120, wherein opposing ends of each strap are connected to the interior 120 by plate 14 and post 16 connectors. Such retaining elements enable slidable removal and retention, while being beneficial in maintaining the predictable order within the interior 120, while also reducing any damage that may result from shifting of the desired paraphernalia.

The housing 110 is dimensioned to provide the interior 120 with sufficient volume to contain medicament 68 and associated paraphernalia. Of course, the housing 110 (and thus the lid 10 and the main body 12) may take any shape so long as it functions within the scope of the present invention.

The lid 10 is hingedly coupled to main body 12 by cooperating spaced apart hinge knuckles 54 and 56 so that the lid 10 moves relative to the main body 12 between a closed condition and an open condition providing access to the main body interior 120. The hinge knuckles 54, 56 define a lumen through which a hinge pin 58 is disposed. The hinge pin 58 may be dimensioned and adapted to be a pipe cleaning tool to be slidably received into the pipe 62 for dislodging residual medicament.

The lid 10 and main body 12 may provide a clasp 46 with nubs 50 to catch on clasps detents 52 in the closed condition. The clasp 46 may be connected to the main body 12 or the lid 10 by clasp connectors 48. It will also be appreciated that the clasp 46 need not also catch on the detents 52 but may be any type of mechanism known in the art used to maintain the lid 10 in the closed condition. The clasp 46 of the lid 10 or some other lip element (not shown) of the lid 10 may be adapted to clip interchangeable design covers for personalizing the lid 10.

The interior 120 provides a grinder element composed of a stationary grinder portion 24 disposed along the interior of the main body 12 and a cooperating rotating grinder portion 32 disposed along the interior of the lid 10, wherein the rotating grinder portion 32 protrudes slightly through the lid 10, as illustrated in FIG. 1. Each grinder portion 24, 32 is shaped so as to define a grinder space, and may be dimensioned so that one grinder portion 24 or 32 partially nests in the other cooperating grinder portion 32 or 24 in the closed condition. In other embodiments, there may be no partial nesting.

Figure 7:
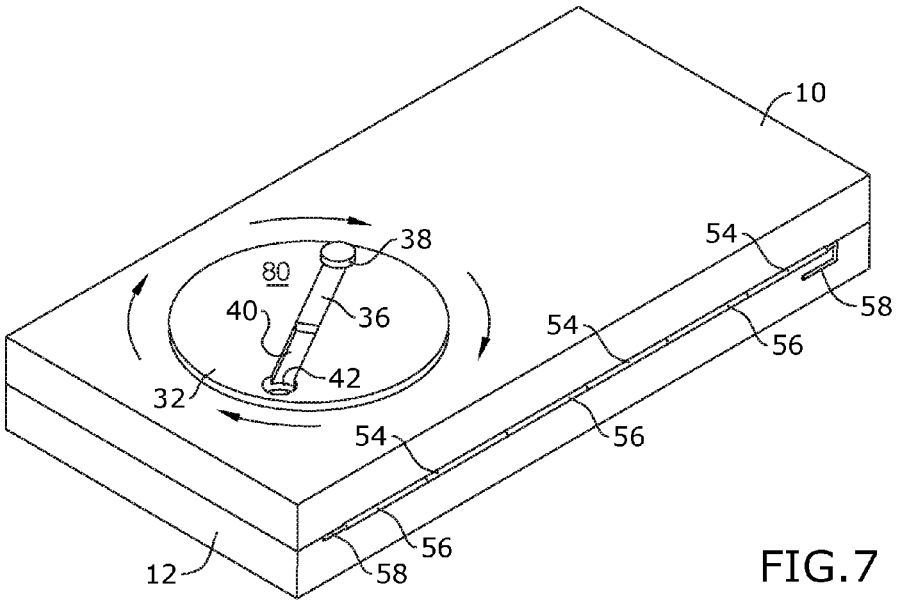
FIG. 7 is a perspective view of an exemplary embodiment of the present invention, illustrating the rotation of the grinder arm in operation.

The rotating grinder portion 32 provides an operative surface 80, that protrudes through the lid 10. The operative surface 80 provides a grinder arm 36 having an arm knob 38, wherein the grinder arm 36 rotated about an axis of rotation, wherein the grinder arm 36 is operatively connected to rotate the rotating grinder portion 32 in either the open or closed condition. The operative surface 80 provides an arm and knob slot 42, 44 and a pivot point 44 so that the grinder arm 36 pivots about the pivot point 44 between a storage condition within the arm and knob slots 42, 44 and an operative condition for rotating about the axis of rotation, as illustrated in FIG. 7.

Figure 4:
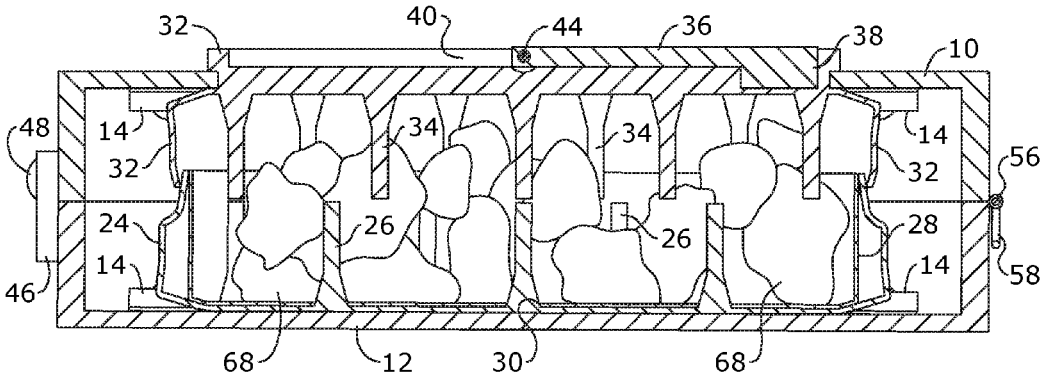
FIG. 4 is a section view of an exemplary embodiment of the present invention, shown with medicament in the grinder, taken along line 4-4 of FIG. 1.
Figure 5:
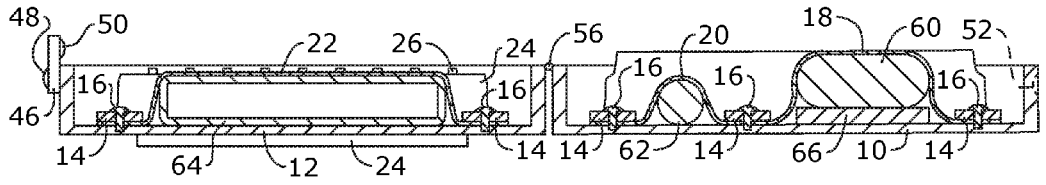
FIG. 5 is a section view of an exemplary embodiment of the present invention, taken along line 5-5 of FIG. 2.

Each grinder portion 24, 32 provides spikes 26, 34, respectively, that protrudes through their associated grinder space and at least adjacent to the other grinding portion's grinder space, as illustrated in FIG. 4. In any event, the spikes 26, 34 are dimensioned and adapted so that they do not collide during use of the rotating grinder portion 32.

Figure 3:
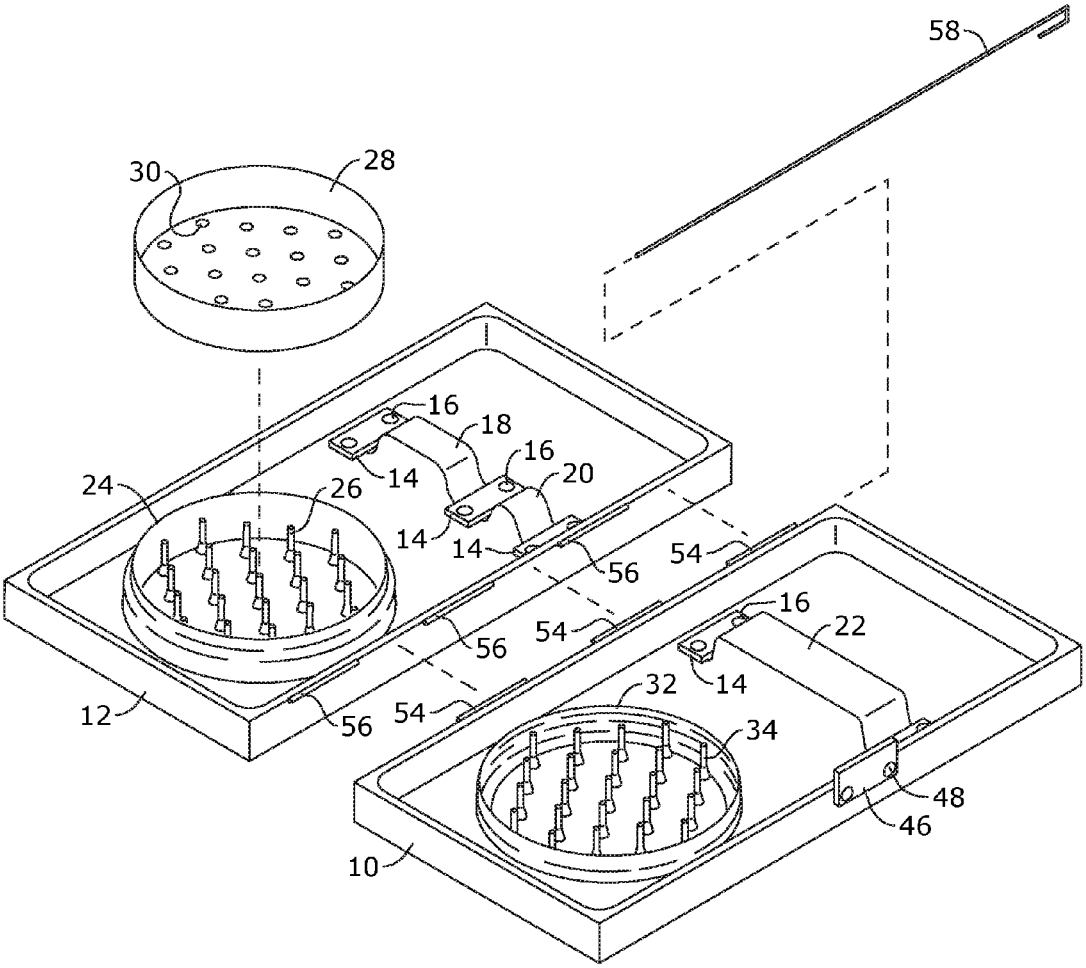
FIG. 3 is an exploded view of an exemplary embodiment of the present invention.
Figure 6:
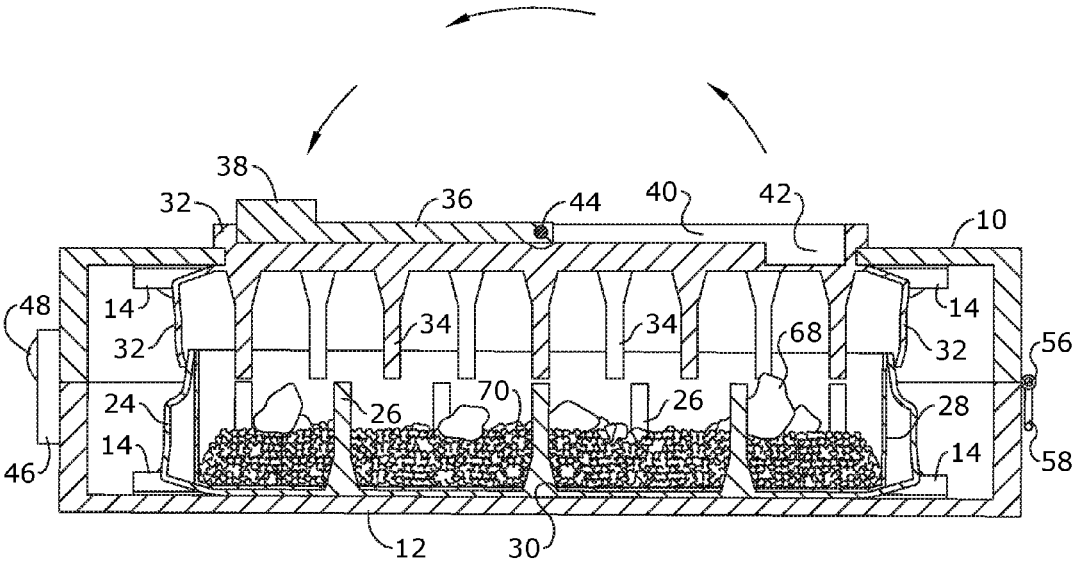
FIG. 6 is a section view of an exemplary embodiment of the present invention, illustrating a disposition of a grinder arm into an operative, grinding position, and shown with partially ground medicament in the grinder.

A medicament tray 28 with holes 30, wherein the holes are adapted to slide along the spikes 26 of the stationary grinder portion 24 so that the medicament tray 28 nests therein, as illustrated in FIG. 6. In this nested configuration, in the closed condition, when a user rotates the grinder arm 36, the rotating grinder portion 32 rotates relative to the stationary grinder portion 24 wherein medicament clumps 68 within the grinder space and within the medicament tray 28, as illustrated in FIG. 4, may be ground and broken apart by the action of the spikes 26, 34, resulting in ground medicament 70, as illustrated in FIG. 6. Then the user may move the lid 10 the open condition and slidably remove the medicament tray 28, as illustrated in FIG. 3, so the ground medicament 70 it retains may be smoked with the rolling paper 66 or the pipe 62. Subsequent to using the pipe 62, the user may use the hinge pin 58 with the hooked end to clean out the bowl or tube of the pipe 62.

It should be understood, of course, that the foregoing relates to exemplary embodiments of the invention and that modifications may be made without departing from the spirit and scope of the invention as set forth in the following claims.

What is claimed is:

1. A medicament management kit, comprising:

a main body;

a lid pivotally coupled to the main body so as to moveable between a closed condition defining an interior housing and an open condition to access said interior housing;

wherein the interior housing provides a stationary grinder portion connected to the main body and a rotating grinder portion connected to the lid, and wherein the stationary and rotating grinder portions abut in the closed condition; and an operative surface of the rotating grinder portion protruding through the lid, wherein the operative surface provides a grinder arm operatively connected to the rotating grinder portion for selectively rotating grinder portion rotates relative to the stationary grinder portion.

2. The medicament management kit of claim 1, further comprising a plurality of grinder spikes in both the stationary and rotating grinder portion.

3. The medicament management kit of claim 2, further comprising a medicament tray having a plurality of holes for slidably receiving the plurality of grinder spikes of the stationary grinder portion for nesting the medicament tray in the stationary grinder portion.

4. The medicament management kit of claim 3, further comprising a plurality of paraphernalia retained in the interior housing, wherein the plurality of medicament paraphernalia comprises a tubular pipe.

5. The medicament management kit of claim 4, further comprising:

a plurality of hinge knuckles spaced apart along cooperating edges of both the main body and the lid so that the plurality of hinge knuckles align to define a singular lumen; and a hinge pin in the singular lumen so that the lid is pivotally coupled to the main body, wherein the hinge pin is dimensioned and adapted to slide out of the singular lumen and into the tubular pipe for cleaning said tubular pipe.

6. The medicament management kit of claim 5, wherein the plurality of medicament paraphernalia comprises a lighter.

* * * * *